United States Patent [19]

Hirata et al.

[11] Patent Number: 4,597,662

[45] Date of Patent: Jul. 1, 1986

[54] COPIER START BUTTON WITH DIAGNOSTIC INFORMATION

[75] Inventors: Sumiaki Hirata, Aichi; Masazumi Ito, Toyohashi; Kenji Shibazaki, Aichi, all of Japan

[73] Assignee: Minolta Camera Kabushiki Kaisha, Osaka, Japan

[21] Appl. No.: 575,805

[22] Filed: Jan. 31, 1984

[30] Foreign Application Priority Data

Jan. 31, 1983 [JP] Japan ..... 58-14991

[51] Int. Cl.[4] ..... G03G 21/00

[52] U.S. Cl. ..... 355/14 R; 340/715; 355/3 R

[58] Field of Search ..... 355/14 R, 14 C, 1, 3 R; 340/286 M, 524, 525, 715, 784, 674, 691

[56] References Cited

U.S. PATENT DOCUMENTS 4,390,872 6/1983 Murakami et al. ..... 340/784 X
4,394,087 7/1983 Irie et al. ..... 355/3 R
4,441,804 4/1984 Shibazaki et al. ..... 355/14 R
4,451,136 5/1984 Tanioka et al. ..... 355/14 R
4,475,806 10/1984 Daughton et al. ..... 355/14 R
4,503,407 3/1985 Ogura ..... 340/784 X

FOREIGN PATENT DOCUMENTS 50-19376 6/1975 Japan .
2019628 10/1979 United Kingdom ..... 340/715

*Primary Examiner*—R. L. Moses
*Attorney, Agent, or Firm*—Price, Gess & Ubell

[57] ABSTRACT

An operation device for use in a copying machine which comprises a visual display unit on a copy start button of the copying machine for displaying various operational states of the copying machine by different figures or patterns representing the contents of the states of the copying machine. The patterns of the display unit is controlled in response to signals fed from a control device of the copying machine.

11 Claims, 20 Drawing Figures

Fig. 6

| | | | |
|---|---|---|---|
| JAM1 | J 1 | JAM2 | J2 |

Fig. 7

Fault of optical system

Fault of exposure lamp

| | | | |
|---|---|---|---|
| | C1 | | C4 |

Fig. 8

Upper paper empty

Lower paper empty

| | | | |
|---|---|---|---|
| | PA | | Pb |

Fig. 9

Lens is moving

| | | | |
|---|---|---|---|
| | UO | WAIT | U1 |

COPIER START BUTTON WITH DIAGNOSTIC INFORMATION

FIELD OF THE INVENTION

The present invention generally relates to an operation device for use in a copying machine and, more particularly, to an operation device having a display arrangement for displaying various information of operation and fault conditions of the copying machine.

BACKGROUND OF THE INVENTION

Generally, copying machines are provided with a display arrangement for displaying various information relating to the copying operation such as paper size, the number of copies to be made, and the possibility or impossibility of copying operation and/or fault conditions such as paper jam, paper shortage. Recently the kinds of functions of the copying machines have been increased, thereby resulting in increasing of the kinds of the information of the copying machines to be displayed. In the conventional copying machines each display is merely illuminated to display various information, therefore there may occur an error or difficulty of recognition of the display when one or more of the displays are changed. Furthermore, in the conventional display arrangements, despite the fact that important information a displayed at a easily recognizable place, the operator of the copying machine tends to watch the display of the number of copies to be made and the copy start button, but the operator does not watch carefully the other displays. This can cause failure or trouble of copy operations.

SUMMARY OF THE INVENTION

Accordingly, the present invention has been developed with a view to substantially eliminate the above discussed problem and has for its object to provide an operation device for use in a copying machine in which various important information is displayed on a copy start button so that the operator of the copying machine can easily and surely recognize the various important information.

Another object of the present invention is to provide an operating device for use in a copying machine which facilitate the maintenance of the copying machine by displaying various faults occurring in the copying machine in the form of a figure or symbol on a copy start button.

BRIEF DESCRIPTION OF THE DRAWINGS

These and other objects and features of the present invention will become clear from the following description taken in conjunction with a preferred embodiment thereof with reference to the accompanying drawings, in which:

FIGS. 6 through 9 are top plan views showing examples of display of a display device used in the embodiment of the present invention;

FIGS. 11 through 14, in which FIG. 11 is comprised of FIGS. 11(*a*) and 11(*b*), FIG. 12 is comprised of FIGS. 12(*a*) and 12(*b*), and FIG. 14 is comprised of FIGS. 14(*a*) and 14(*b*), are flow charts showing a process for controlling the display device used in the embodiment according to the present invention;

DETAILED DESCRIPTION OF THE EMBODIMENT

Figure 1:
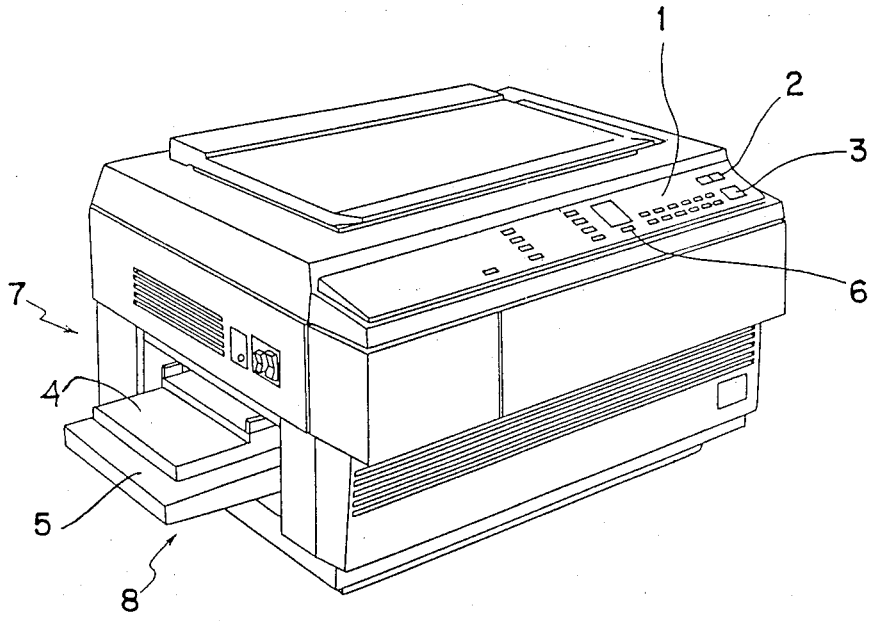
FIG. 1 is a schematic diagram showing an electrophotographic copying machine embodying the present invention.

Before the description of the present invention proceeds, it is to be noted that like parts are designated by like reference numerals throughout the accompanying drawings.

Referring to FIG. 1, a copying machine 10 to which the present invention is applied comprises an operation panel 1. On the operation panel 1, there is provided a display arrangement 2 having 2 digits, each formed by seven light emitting segments made of light emitting diodes arranged in the form of a numeric character of 8 for displaying various information relating to the states of the copying machine such as a paper jam and a copy paper shortage, a print start button 3 having a liquid crystal display arrangement or an LCD display arrangement of a light transmitting type and a cassette selecting button 6 for selecting either of a first kind of paper size in an upper cassette 4 or a second kind of paper size in a lower cassette 5. Said upper cassette 4 is mounted in a upper paper supplying port 7 and said lower cassette 5 is mounted in a lower paper supplying port 8.

Figure 2:
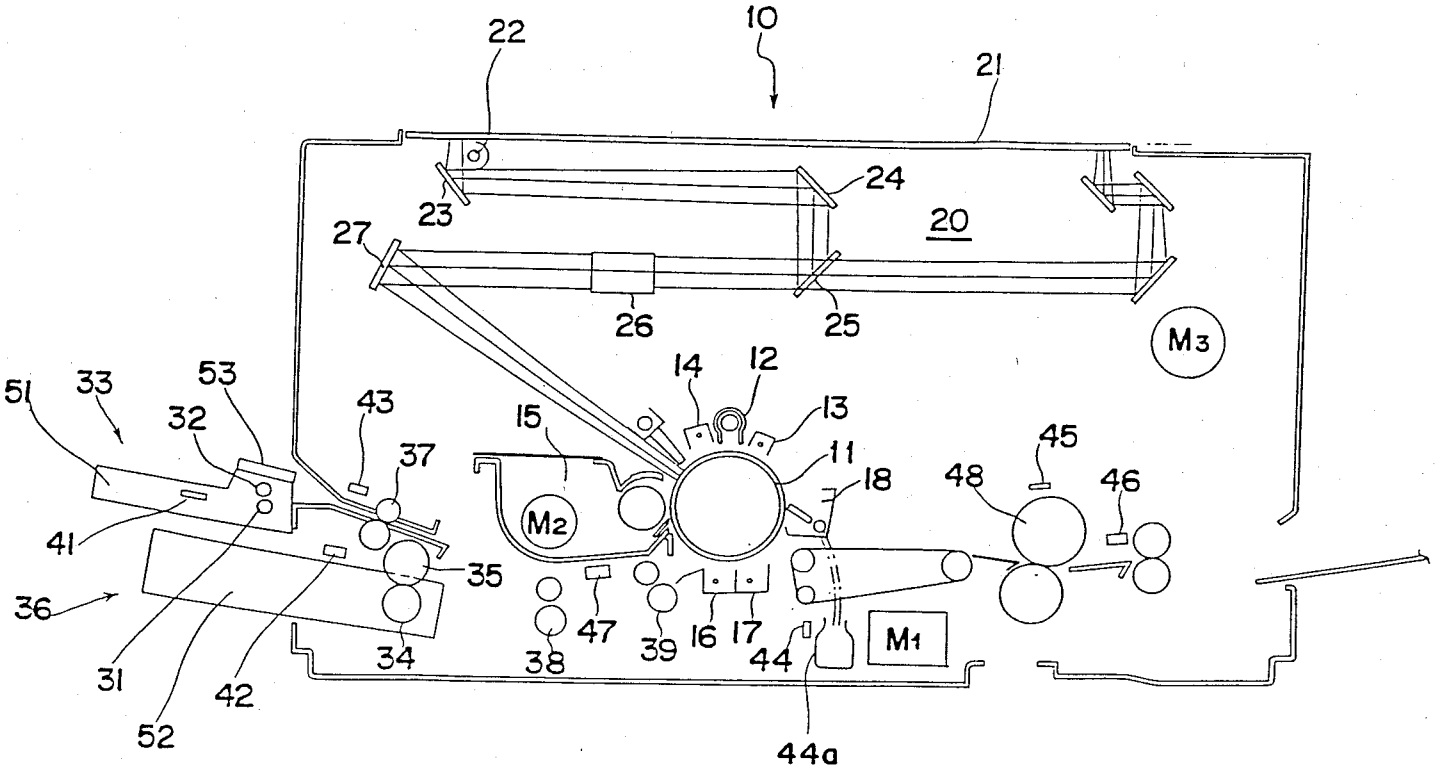
FIG. 2 is a schematic diagram showing the inside of the copying machine shown in FIG. 1.

Referring to FIG. 2, photoreceptor drum 11 is supported at a generally central portion within a machine housing 10 for rotation in a direction counterclockwise as viewed therein. The machine also comprises a main eraser lamp 12, an auxiliary electrostatic charger 13, a main electrostatic charger 14, a developing unit 15, a transfer charger 16, a separator charger 17 for facilitating the separation of a copying paper from the drum 11, and a bladetype cleaning unit 18, all disposed adjacent to and around the drum 11 within the machine housing. The photoreceptor drum 11 is of a construction having its outer peripheral surface provided with a photosensitive layer which, as it moves past the eraser lamps 12 and the electrostatic chargers 13 and 14 during the rotation of the drum 11, can be highly sensitized and electrostatically charged in readiness for its exposure to an image transmitted by means of an optical system 20.

The optical system 20 is supported underneath a transparent original support glass 21 for scanning an original on the support glass 21 from below and includes a light source 22 for exposure, movable mirrors 23, 24 and 25, a projector lens assembly 26 and a fixed mirror 27. At a left-hand portion of the machine 10, the machine is provided with an upper paper supply unit 33 in which the upper cassette 4 is set, including upper paper supply rollers 32 driven through an upper paper supplying clutch 31 and a lower paper supplying unit 36 in which the lower cassette 5 is set, including lower paper supply rollers 35 driven through a lower paper supply clutch 34, the path of travel of each copying paper being defined by roller pairs 37 and 38, a timing roller pair 39, and a fixing unit 48.

An upper paper empty switch 41 and a lower paper empty switch 42 are respectively disposed adjacent to the upper paper supplying unit 33 and the lower paper supplying unit 36 for detecting the paper shortage occurring in a upper cassette 4 and the lower cassette 5.

A paper detecting switch 43 is disposed adjacent to the roller 37 for detecting each of the papers manually inserted in the paper path from the upper paper supplying port 7.

Reference numeral 44 denotes a waste toner detecting switch for detecting whether or not the waste toner tank 44*a* is fully filled with the waste toner. Reference numeral 45 denotes a temperature sensor for detecting whether or not the temperature of a fixing device 48 reaches a predetermined temperature and the fixing device 48 is ready for a fixing operation. Reference numerals 46 and 47 denote paper detecting switches for detecting the copying papers transferred along the paper transferring path.

Reference numeral 53 shows a manual paper feeding stage for supplying manually one sheet of the copying paper at a time.

Figure 3:
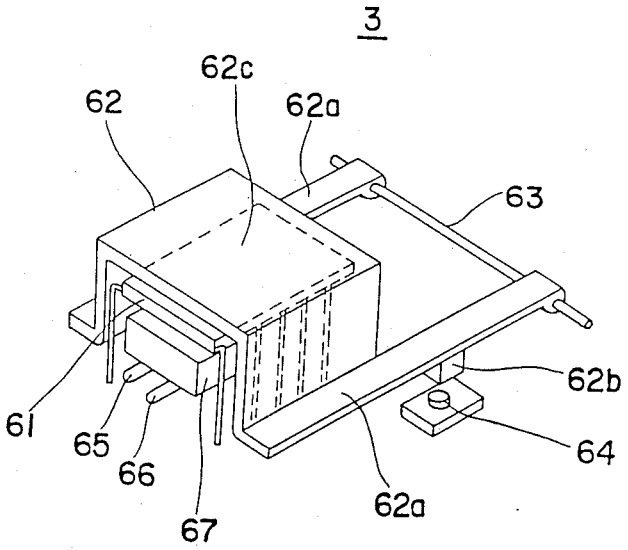
FIG. 3 is a perspective view showing a start button used in the copying machine shown in FIG. 1.

As shown in FIG. 3, the print start button 3 comprises a key top 62 made of a transparent plastic resin material covering a liquid crystal display unit 61 of a light transmitting type. The key top 62 is made of a generally U channel member having a flat top portion 62*c* acting as a pressed face of the print start button 3 and a pair of lower supporting levers 62*a* extending parallelly with the both ends thereof rotatably supported on a fixed shaft 63. At the bottom face of one of the supporting levers 62*a*, a projection 62*b* is projected so as to face to a switch 64 supported on a fixed member (not shown), when the top face of the key top 62 is manually pressed downwardly the projection 62*b* pushes the switch 64 causing it to be in and ON state to produce a signal instruct to start the copy operation. Upon releasing the pressing operation of the key top 62. The projection 62*b* can automatically leave the switch 64 by a force of a spring member (not show) . A green light source 65 and an orange light source 66 are disposed below the liquid crystal display unit 61 with a light diffusing plate 67 interposed therebetween so that the rays of light from either of the green light source 65 or the orange light source 66 are diffused to illuminate the liquid crystal display unit 61 uniformly from below. Each of the light sources 65 and 66 is referred to as "back light" in the flow charts explained later.

Figure 4:
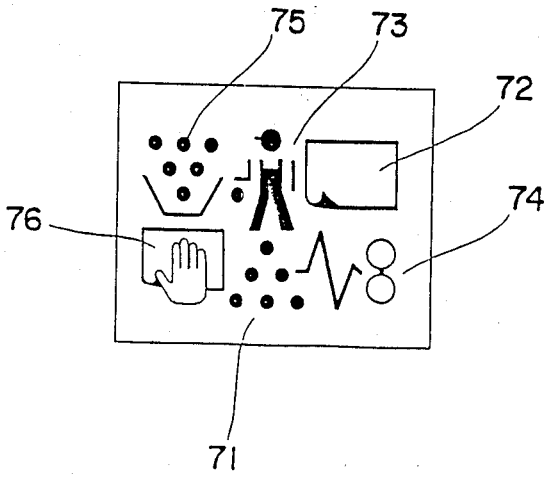
FIG. 4 is a top plan view of the start button shown in FIG. 3.

The liquid crystal display unit 61 is so arranged as to display various graphic patterns or symbols as shown in FIG. 4 in which the pattern 71 indicate a toner empty which means shortage of toner in the toner tank, 72 indicating a copying paper empty which means shortage of the copying papers, 73 indicating a service man call which represents the request of checking and maintenance by a service man, 74 indicating a paper jam, 75 indicating a full of waste toner which means the waste toner tank is fully filled with the waste toner and 76 indicating a manual paper feeding.

Figure 5:
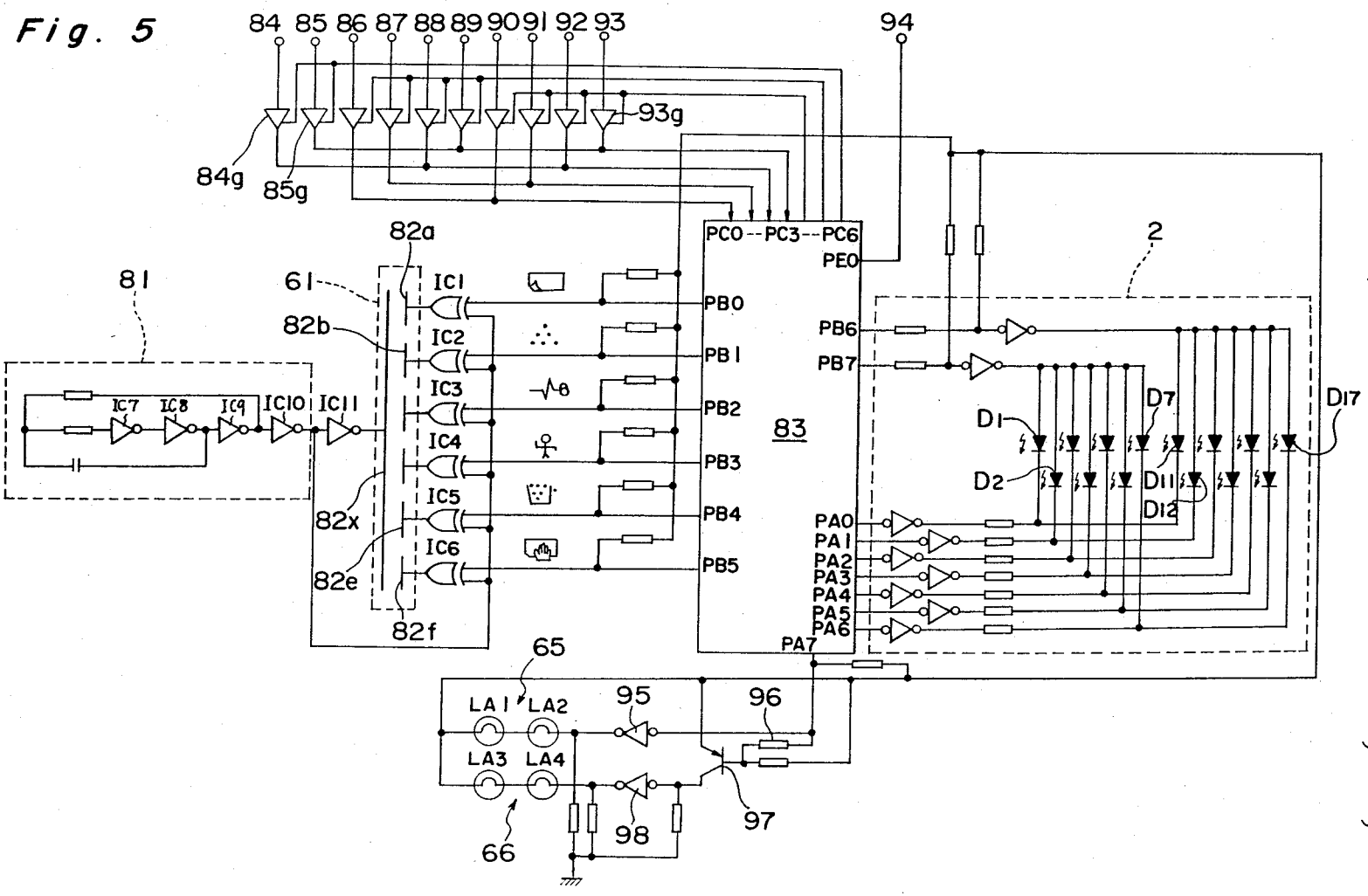
FIG. 5 is a block diagram showing one embodiment of the present invention.

FIG. 5 shows a circuit diagram of the control device for the liquid crystal display unit 61, and the display arrangement 2 wherein an oscillator 81 composed of inverters IC7 through IC10 oscillates a series of rectangular pulses of about 30 KHz. The output terminal of the oscillator 81 is connected with a common electrode 82X of the crystal liquid display unit 61 through an inverter IC11. Also the output terminal of the oscillator 81 is connected with the respective one input terminals of exclusive OR gates IC1 through IC6 the other input terminals of which are connected with the output terminals PB0 through PB5 of a central processing unit 83 (referred to as CPU hereinafter) made of a microcomputor for controlling the display of each of the patterns 71 through 76. The output terminals of the exclusive OR gates IC1 through IC6 are connected with segment electrodes 82*a* through 82*f*, each of which is arranged in the liquid crystal display unit 61 for controlling illumination of the respective patterns 71 through 76. In this arrangement, when the output terminal PB0 of the CPU 83 becomes low level (expressed by "L" hereinafter), a pulse train of a rectangular shape is applied between the common electrode 82X and the segment electrode 82*a* thereby causing the pattern 72 showing the paper empty is illuminated. In a similar manner as described above, the toner empty pattern 71 is illuminated by the "L" output of the terminal PB1, the paper jam pattern 74 by the "L" output of the terminal PB2, the service man call pattern 73 by the "L" output of the terminal PB3, the waste toner full pattern 75 by the "L" output of the terminal PB4 and the manual paper feeding pattern 76 by the "L" output of the terminal PB5. Terminals 84 through 93 show input terminals for receiving control signals representing various copying conditions fed from a control device (not shown) for controlling the general operation of the copying machine. The terminal 84 receives a signal representing the movement of the lens 26 for transferring the image of the original to be copied to the photoreceptor drum 11 in a case of changing of the copy magnification, the terminal 85 receives a signal from the paper detecting switch 43 for detecting the manual paper feeding operation, the terminal 86 receives a signal of the temperature sensor 45 showing that the temperature of the fixing device 48 reaches a predetermined value. The terminal 87 receives a signal representing illumination of the light source 22 for exposure, the terminal 88 receives a signal from the upper paper empty switch 41 representing the paper shortage of the copying papers in the upper cassette 4, the terminal 89 receives a signal from the lower paper empty switch 42 representing the paper shortage of the copying papers in the lower cassette 5. The terminals 90 and 91 receive signals of the paper detecting switches 46 and 47, the terminal 92 receives a signal from the waste toner full detecting switch 44 for detecting the state of being full of the waste toner in the waste toner tank 44*a*, the terminal 93 receives a signal from a toner empty switch (not shown) for detecting the shortage of the toner and the terminal 94 receives a pulse train generated upon rotation of a motor M1 for driving the photo receptor drum 11.

These signals are applied to the input terminals PC0 through PC7 of the CPU 83 through respective gates 84*g* through 93*g* which are individually opened at the corresponding periods by strobe output pulses generated from the terminals PC4 through PC6 in a time divisional manner.

A pair of lamps LA1 and LA2 forming the green light source 65 has their one terminal connected with an output terminal PA7 of the CPU 83 through a buffer 95. The output terminal PA7 is adapted to be "L" when the copying machine is operable for copy and is further connected with the base of a transistor 97 through a resistor 96, the collector of which is connected with one terminal of a pair of lamps LA3 and LA4 forming the orange light source 66 through a buffer 98. By this arrangement, when the copying machine is operable for copy, the lamps LA1 and LA2 of the green light source 65 is illuminated by the "L" output of the terminal PA7. On the contrary when the copy machine is unoperable for copy, the terminal PA7 becomes high level (expressed by "H" hereinafter), so that the lamps LA1 and LA2 are off and the lamps LA3 and LA4 of the orange light source are illuminated by the "L" output of the buffer 98 upon cut off of the transistor 97.

Seven light emitting diodes D1 through D7 and another seven light emitting diodes D11 through D17 forming the seven segment display unit 2 for displaying 1 digit and 10 digit respectively are connected with output terminals PA0 through PA6 of the CPU 83 for displaying various states of the copying machine as shown in FIGS. 6 through 8. The displays J1 and J2 shown in FIG. 6 are for the paper jam. The character C1 and C4 in FIG. 7 show the service man call due to the fault of the optical system 20 and the fault of the exposure lamp 12, The characters PA and PB (Pb) in FIG. 8 represent the upper paper empty and the lower paper empty condition. The characters U0 and U1 in FIG. 9 show the WAIT condition which occurs either while the lens assembly 26 is moving and/or before the temperature of the fixing device 48 reaches a predetermined value.

Operation of the copying machine as described above will be described with reference to FIGS. 10 through 15.

Figure 10:
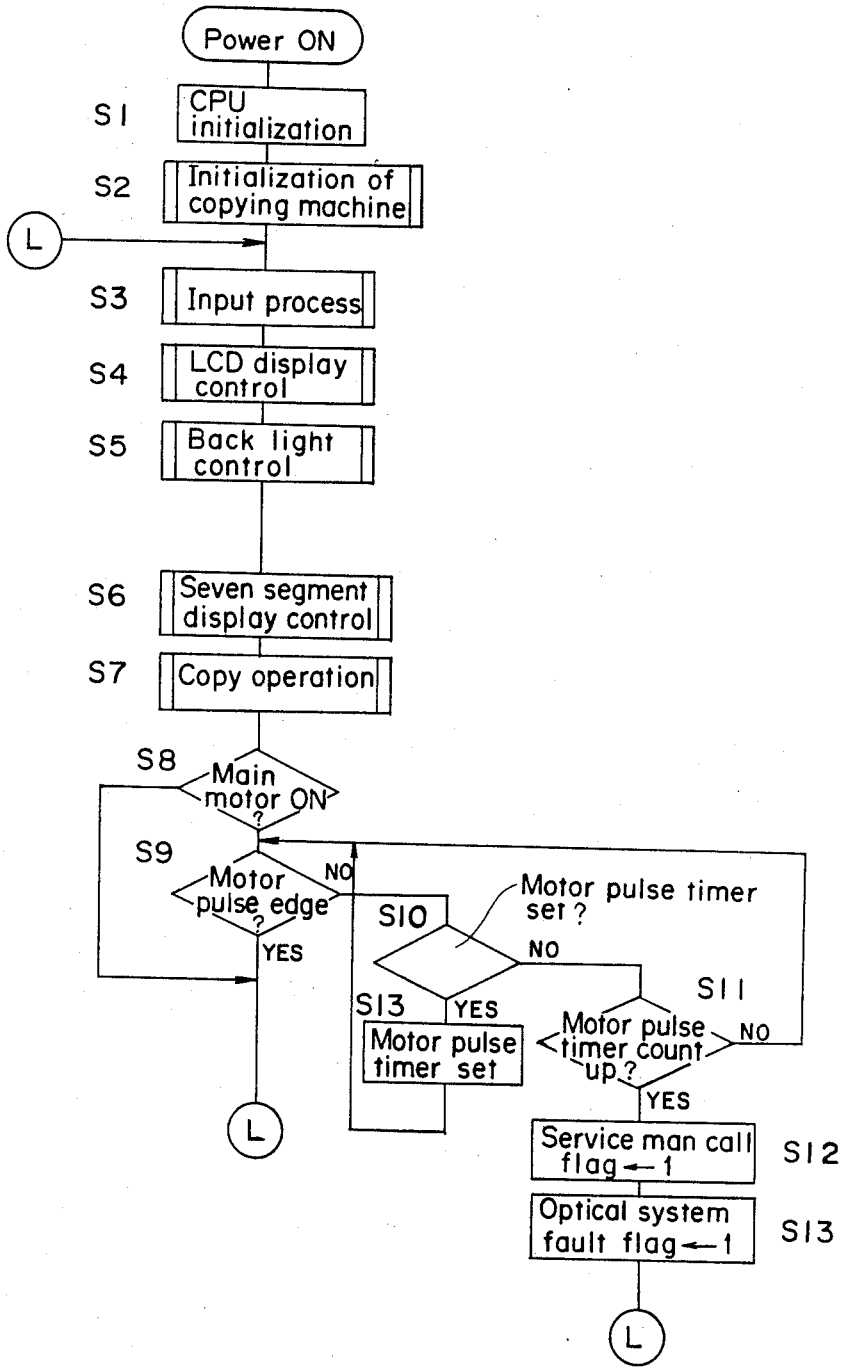
FIG. 10 is a flow chart showing the sequence of operation of an essential portion of the present invention.

Referring to FIG. 10, in the steps S1 and S2, the CPU 83 and the copying machine are initialized when the power source is turned on. In the step S3, various internal information for controlling the copying machine are taken into the CPU 83 in response to the signals applied to the input terminals 84 through 93. In the subsequent step S4, display process is executed for displaying the various information on the LCD display unit 61 on the basis of the internal information taken at the step S3. In the step S5, illumination of the light source 65 and 66 in the print start button 3 is controlled in response to the internal information. Namely when the copying machine is operable for copying the green lamps 65 are illuminated, on the other hand, when the copying machine is inoperable, the orange lamps 66 are illuminated.

In the step S6, if there is a paper jam in the copying machine and therefore a jam flag is "1" and/or a service man call flag is "1", the seven segment display unit 2 displays the amount of the remaining papers to be copied when the copy start button 3 is depressed.

In the step S7, if a copy start flag is "1", the copying is performed. Subsequent to the above described processes, in a case where the electric power is applied to the main motor M1 for rotating the drum 11, motor pulses from a pulse generator attached to the main motor M1 are detected in the step S9, then the program flow returns to the step S3. If the motor pulses are not detected in the step S9, the program flow proceeds to the step S10 in which whether or not a motor pulse timer is set is judged, and if the motor pulse timer is not set, it is set in the step S13 and in turn the program flow returns to the step S9. In a case where the motor pulse timer is set, the program flow proceeds to the step S11 to judge whether there is a motor pulse within the period set in the motor pulse timer. If the motor pulse is not detected within the said period, the program flow proceeds to the steps S12 and S13 to make the service man call flag and the optical system fault flag "1" respectively.

Figure 11A:
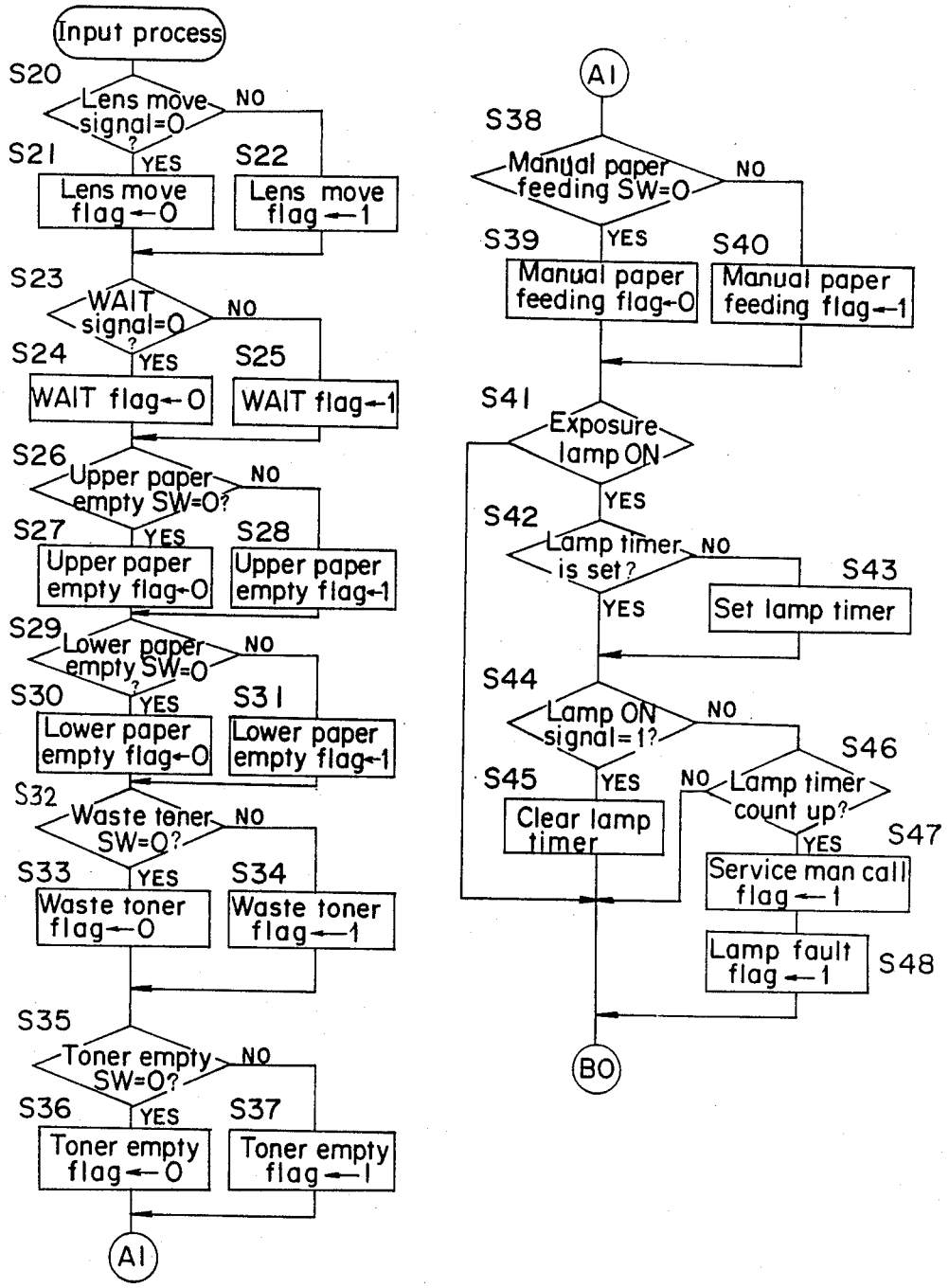
Figure 11B:
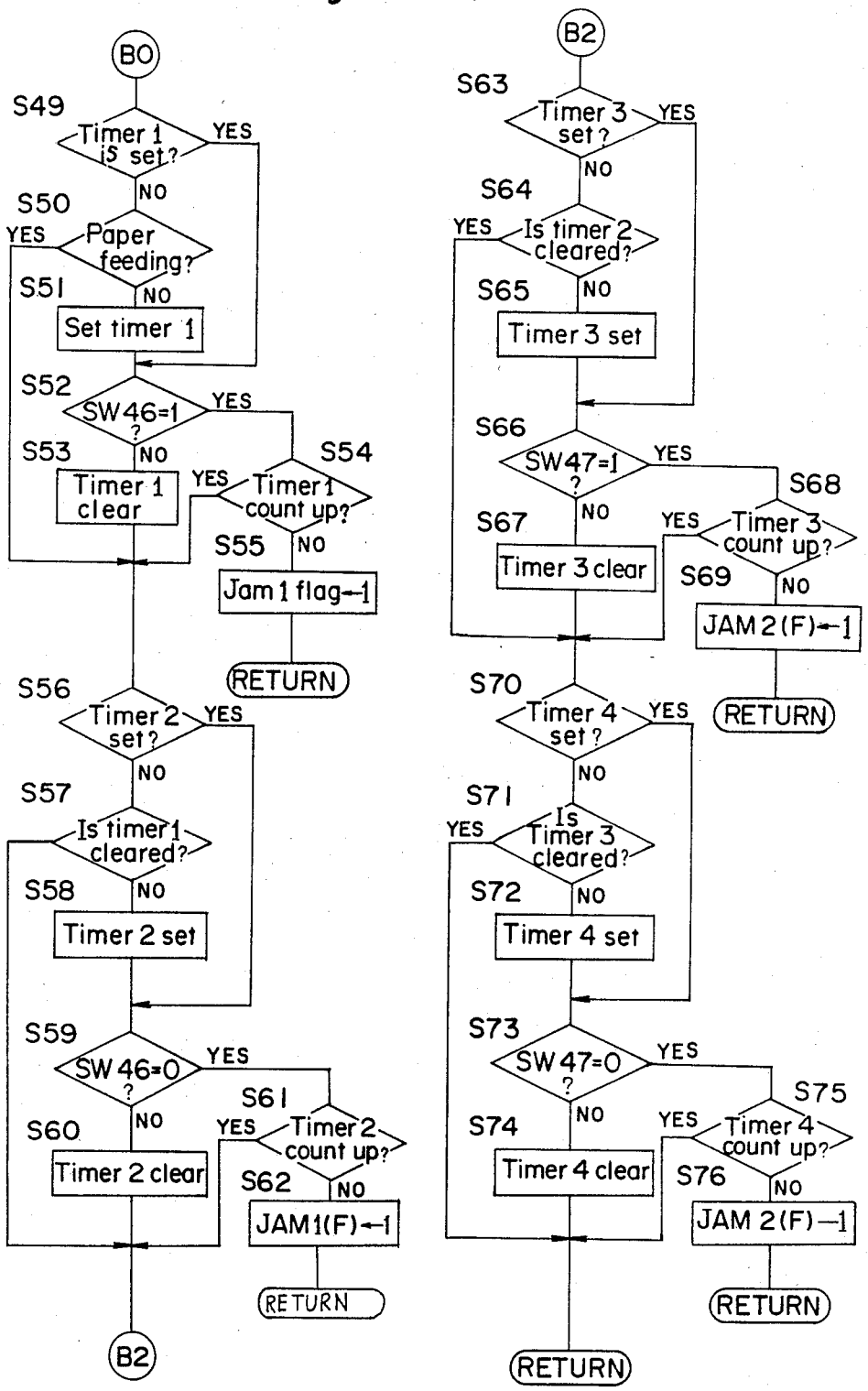

FIG. 11 shows the detailed procedure of the sequence of the process of taking the internal information in the CPU 83 shown in the step S3.

The lens moving signal is judged in the step S20 and a lens moving flag is made "1" or "0" in the steps S21 or S22 depending on presence or absence of the lens moving signal. A WAIT signal fed from the sensor 45 is detected in the step S23. When the fixing device 48 is heated to the predetermined temperature the WAIT signal becomes "0". When the WAIT signal is "0" a WAIT flag is made "0" in the step S24 and when the WAIT flag is "1", the WAIT flag is made "1" in the step S25.

The state of the upper paper empty switch 41 is detected in the step S26. When the shortage of the copying papers in the upper cassette 4 occurs, the upper empty switch 41 becomes "1", thereby causing an upper paper empty flag to be "1" in the step S28. When the papers are present in the upper cassette, the upper paper empty switch 41 is "0" thereby causing the upper paper empty flag to be "0" in the step S28. Similar procedures are taken about the lower cassette 5 in the steps S29 through S31. The state of the waste toner switch 44 is judged in the step S32. When the waste toner tank 44*a* is fully filled with the waste toner, the waste toner switch 44 becomes "1", thereby causing a waste toner flag to be "1" in the step S34. If the waste toner switch 44 is "0", the waste toner flag is made "0" in the step S33. The state of the paper detecting switch 43 is detected in the step S38 for judging the manual paper feeding operation. When the paper detecting switch 43 is "1" or ON upon setting of the copying paper in the manual paper feeding stage 53, a manual paper feeding flag is made "1" and in turn when the paper detecting switch 43 becomes "0" when the paper manually fed passes over the paper detecting switch 44 thereby causing the manual paper feeding flag to be "0".

The state of the light source 22 for exposure is detected in the step S41. When the light source 22 is made ON, a lamp timer is set in the step S43. Then the program flow proceeds to the step S44 to judge the state of a lamp illuminating signal fed from a light sensor (not shown) to sense the illumination of the light source 22. If the lamp illuminating signal does not change to "1" after a predetermined period set by the lamp timer, the service man call flag and the lamp fault flag are made "1" respectively in the step S47 and S48.

In the steps S46 through S76, the paper jam is detected by the state of the paper detecting switches 46 and 47. When the paper jam is detected by the state of the switch 46, the first paper jam flag is made "1". When the paper jam is detected by the state of the switch 47, the second paper jam flag is made "1".

Figure 12A:
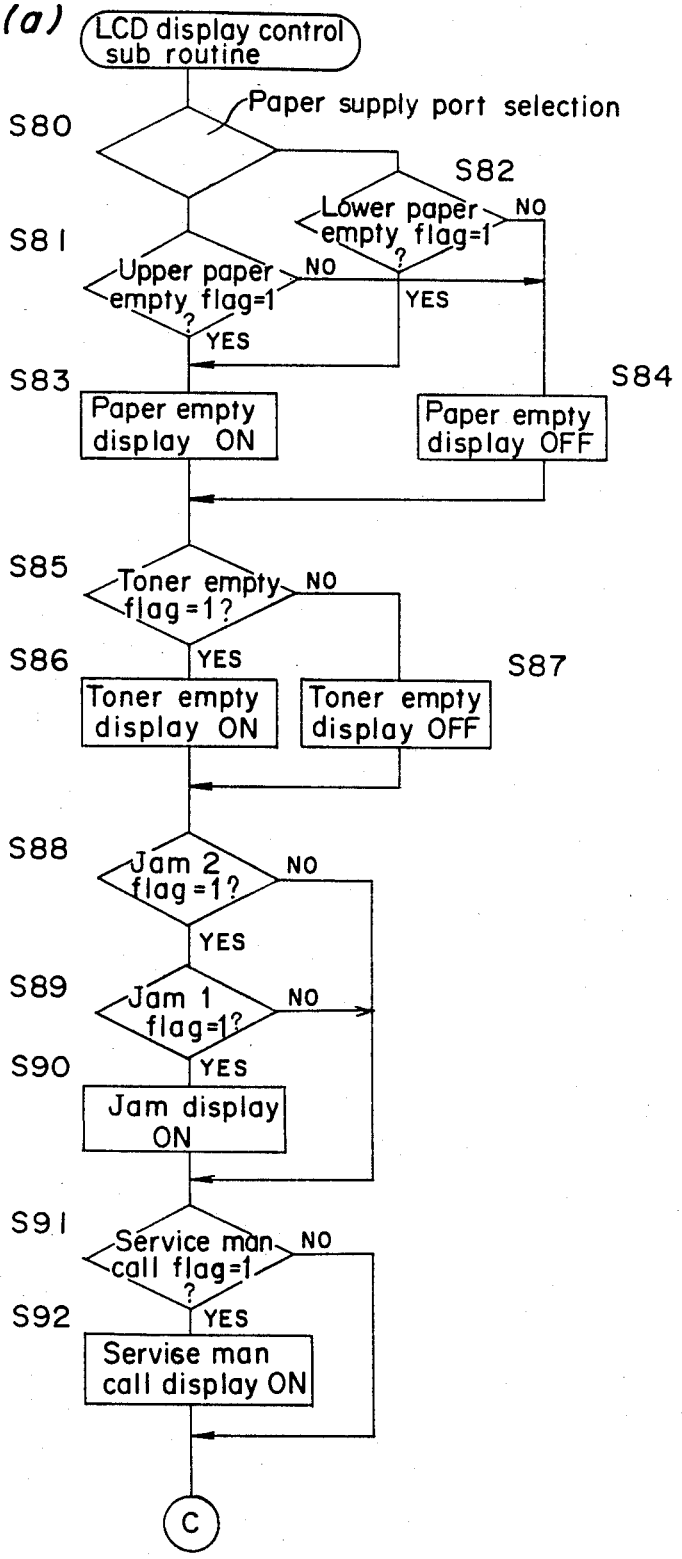
Figure 12:
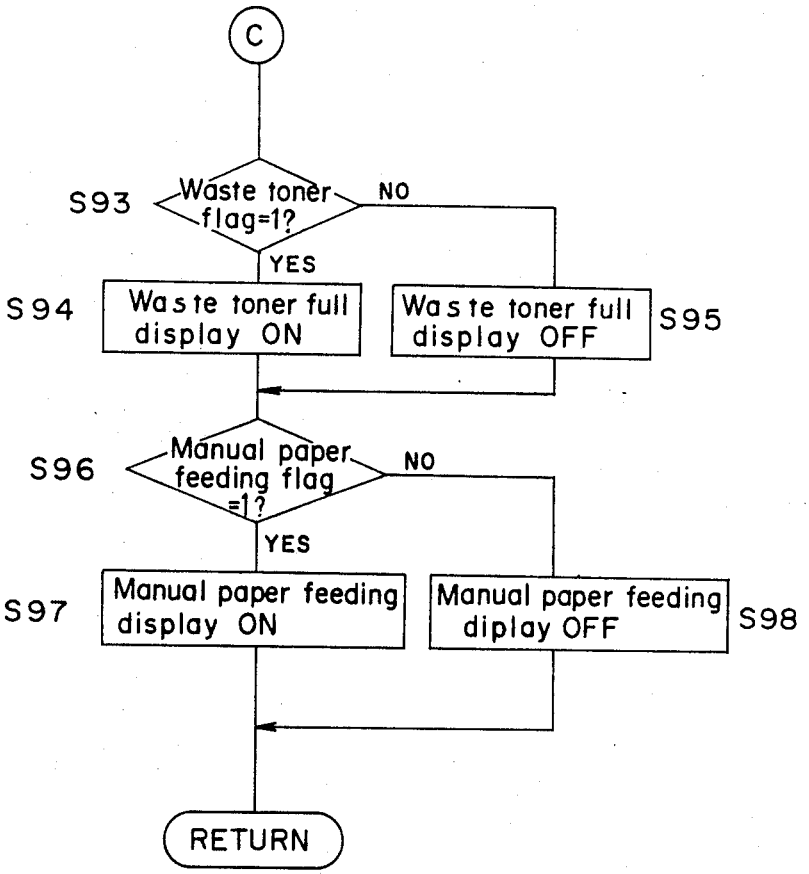

FIG. 12 shows the detailed procedure of the step S4 for displaying the information on the LCD displaying unit 61. In the step S80, the state of the cassette selecting button is judged to determine which of the upper cassette 4 or the lower cassette 5 is selected and the program flow proceeds to either the step S81 or S82 depending on the selection of the cassettes by the cassette selecting button 6, wherein whether the copying papers are present in the selected cassette is judged. When the shortage of the copying papers occurs in the selected cassette, the program flow proceeds to the step S83, whereby the CPU 83 produces the "L" output at the output terminal PB0 so as to supply the alternative electric field between the common electrode 82*x* and the segment electrode 82*a* through the exclusive OR gate IC1 thereby causing the pattern 72 to be illuminated to display the paper empty signal. In the steps S85 through S87, when there is a shortage of toner, the output terminal PB1 of the CPU 83 becomes "L", so as to supply the alternative electric field between the common electrode 82*x* and the segment electrode 82*b* through the exclusive OR gate IC2, thereby causing the pattern 71 to be illuminated to display the toner shortage. In the steps S88 through S90, when the paper jam occurs, the CPU 83 produces the "L" output at the output terminal PB2 so as to supply the alternative electric field between the common electrode 82*x* and the segment electrode 82*c*, thereby causing the pattern 74 to be illuminated to display the paper jam. In the steps S91 and S92, when there is the service man call signal, the CPU 83 produces the "L" output at the output terminal PB3 so as to supply the alternative electric field between the common electrode 82*x* and the segment electrode 82*d* through the exclusive OR gate IC4, thereby causing the pattern 73 to be illuminated to display the service man call. In the steps S93 through S95, when the waste toner tank is full, the CPU 83 produces the "L" output at the output terminal PB4 so as to supply the alternative electric field through the exclusive OR gate IC5 thereby causing the pattern 75 to be illuminated to display that the waste toner tank is full. In the steps S96 through S98, when the manual paper feeding is set, the CPU 83 produces the "L" output at the output terminal PB5 so as to supply the alternative electric field between the common electrode 82*x* and the segment electrode 82*f*, thereby causing the pattern 76 to be illuminated.

Figure 13:
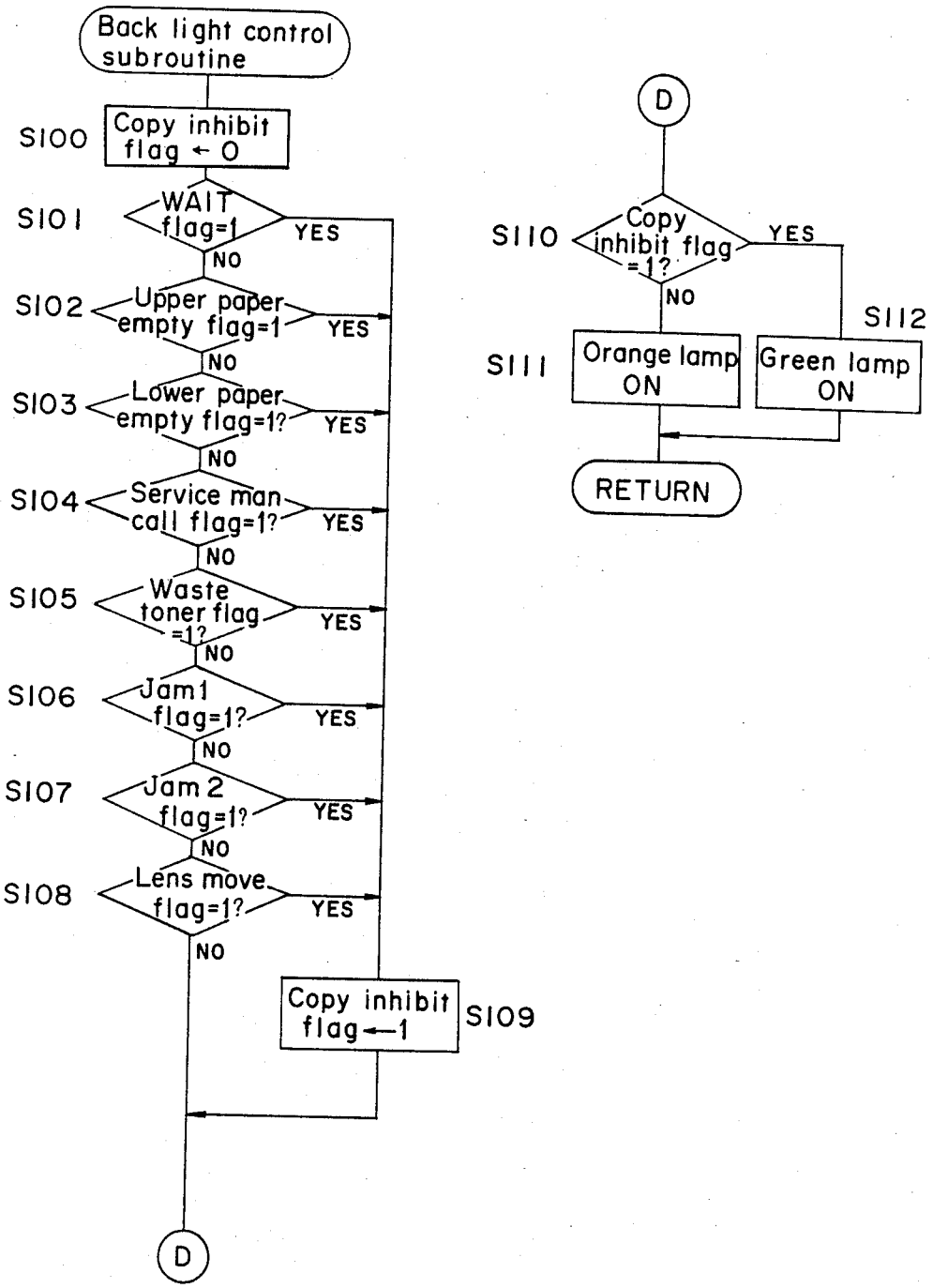

The process of the step S5 for controlling the lamps 65 and 66 are executed according to the procedures shown in FIG. 13. In the steps S100 through S112, when there occur any one or more of the following states the fixing device 48 does not reach the predetermined temperature, i.e., during the WAIT condition, the paper empty,
the paper jam,
the service man call, and
the waste toner is full the copy inhibit flag is made "1" so as to cause the orange lamps 66 to be illuminated. On the other hand, when the fixing device 48 reaches the predetermined temperature, or while the above four states do not occur, the copy inhibit flag is made "0" so as to cause the green lamps 65 to be illuminated.

Figure 14:
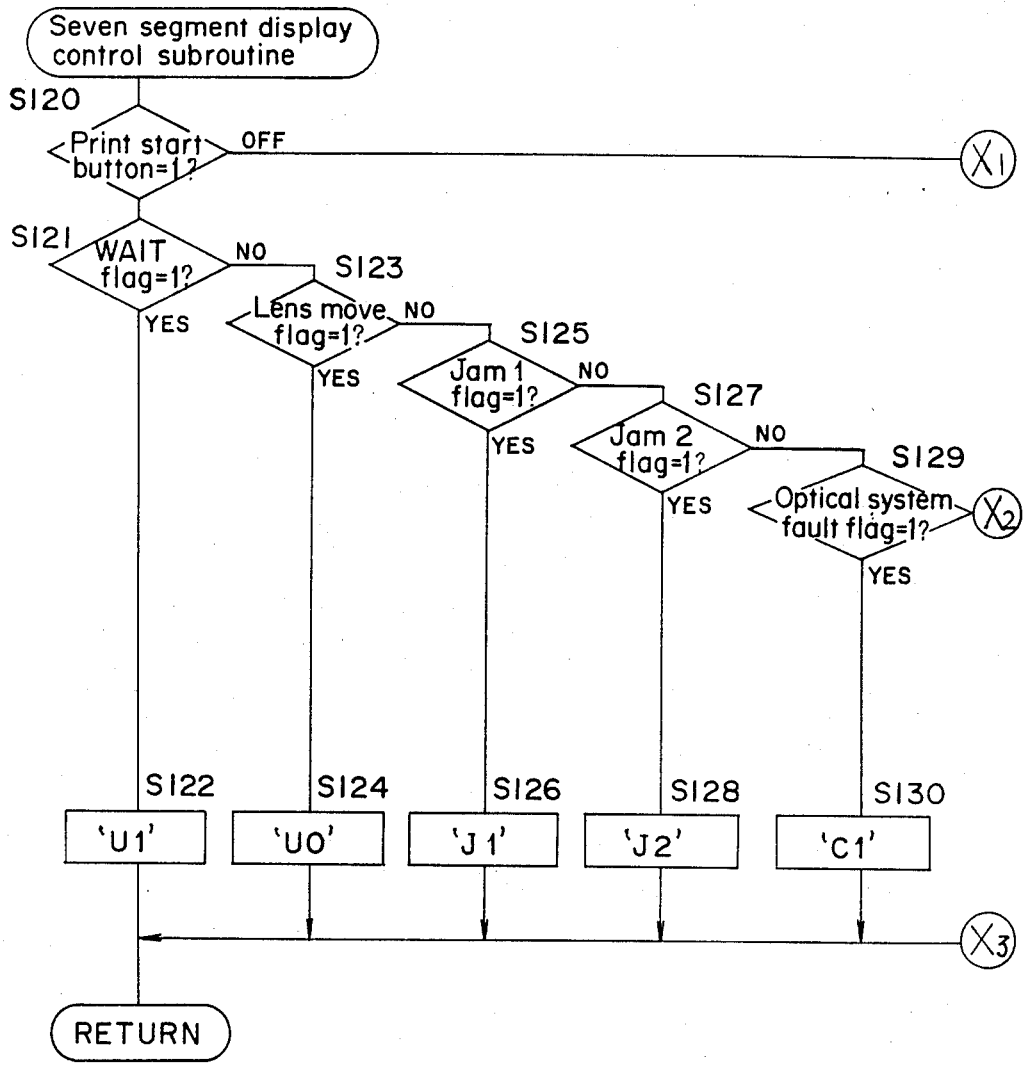
Figure 14:
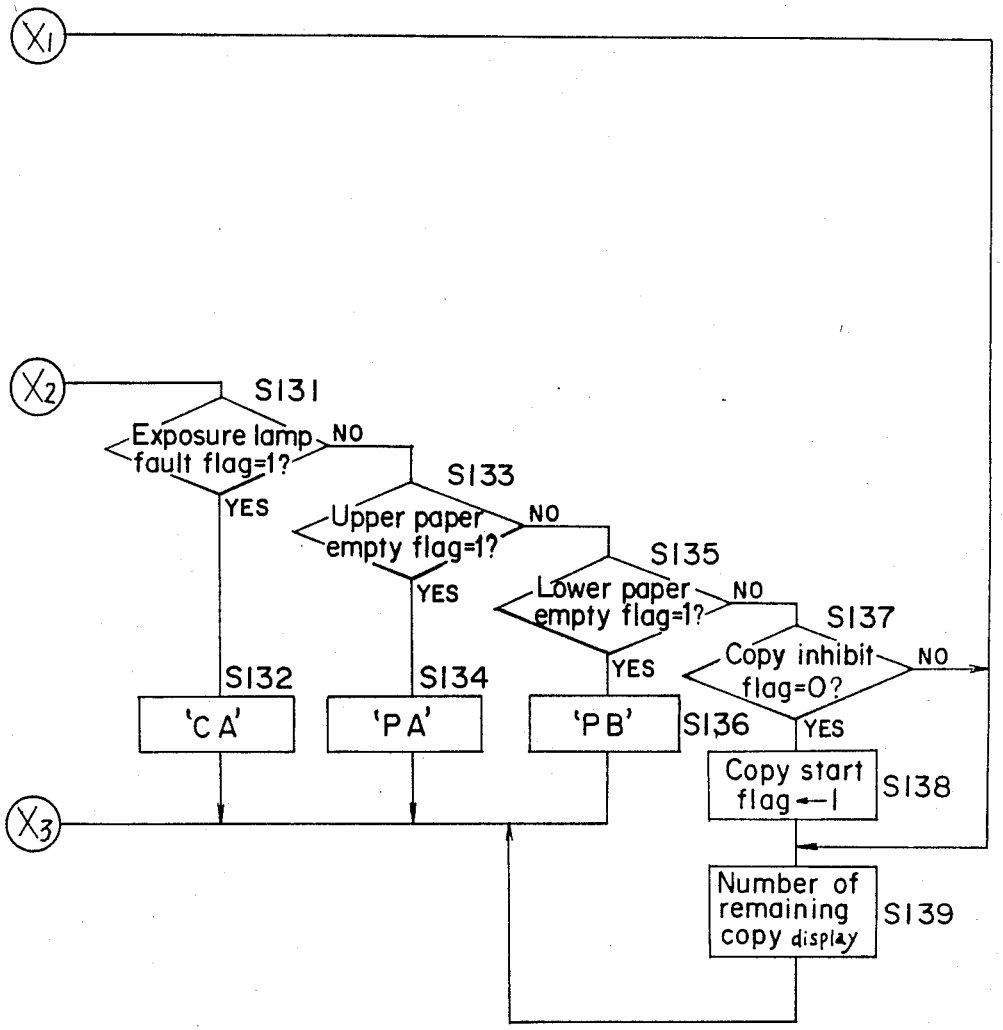

The details of the step S6 for executing the control of the seven segment display device are shown in FIG. 14.

Under the condition that the all of the flags of the WAIT flag, lens moving flag, the first paper jam flag, the second paper jam flag, the optical system fault flag, the exposure lamp fault flag, the upper paper empty flag and the lower paper empty flag are "0", upon the operation of the copy start button 3, the seven segment display device displays the amount of the remaining copy papers in the step S139. In this case if the copy inhibit flag is "0" is judged in the step S137, the copy start flag is set to "1" in the step S138.

On the other hand, if the temperature of the fixing device 48 is not at the predetermined value, therefore "1" of the WAIT flag is judged in the step S12, the seven segment display arrangement 2 displays the character "U1" in the step S122. If the lens 26 of the optical system 20 is moving, therefore "1" of the lens moving flag is judged in the step S123, the character "U0" is displayed in the step S124. If "1" of the first paper jam flag is judged in the step S125, the character "J1" is displayed in the step S126. If "1" of the second paper jam flag is judged in the step S127, the character "J2" is displayed in the step S128. If "1" of the optical system fault flag is judged in the step S129 due to the absence of the motor pulse of the main motor M1, the character "C1" is displayed in the step S130. If the exposure lamp fault flag is "1" by such a condition that the exposure lamp does not illuminate in a predetermined period of time in spite of the application of the power source to the exposure lamp, the character "C4" is displayed in the step S132. If "1" of the upper paper empty flag is judged due to the shortage of the copying papers in the upper cassette 4 in the step S133, the character "PA" is displayed in the step S134. If "1" of the lower paper empty flag is judged due to the shortage of the copying papers in the lower cassette 5 in the step S135, the character "PB" is displayed in the step S136.

By displaying the various information in the seven segment display arrangement 2 as described above, the operator of the copying machine can notice easily the reasons why the copying machine can not be operated.

Figure 15:
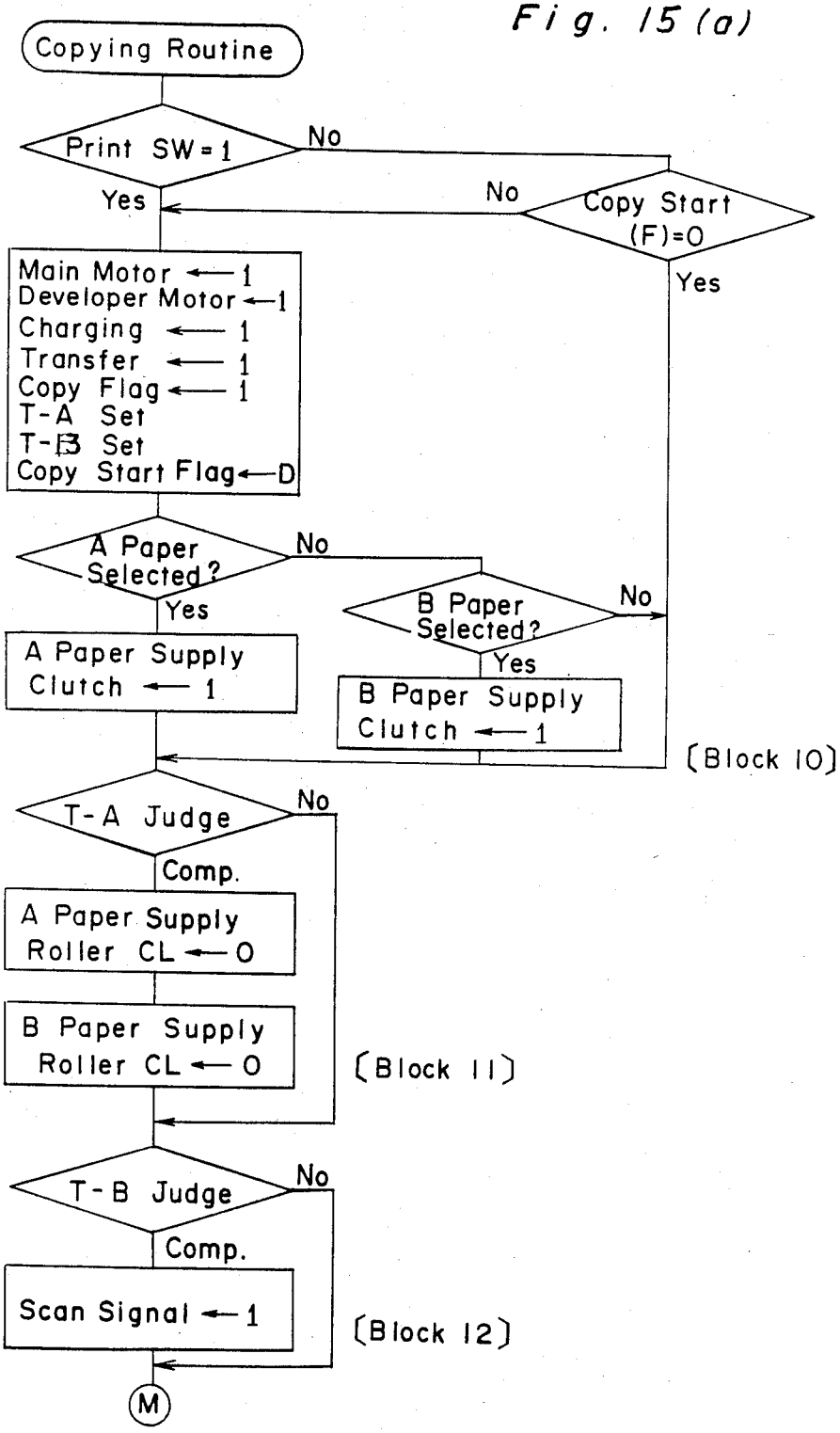
FIG. 15, comprised of FIGS. 15(*a*) and 15(*b*), is a flow chart showing the sequence of the copying operation performed by the machine.
Figure 15:
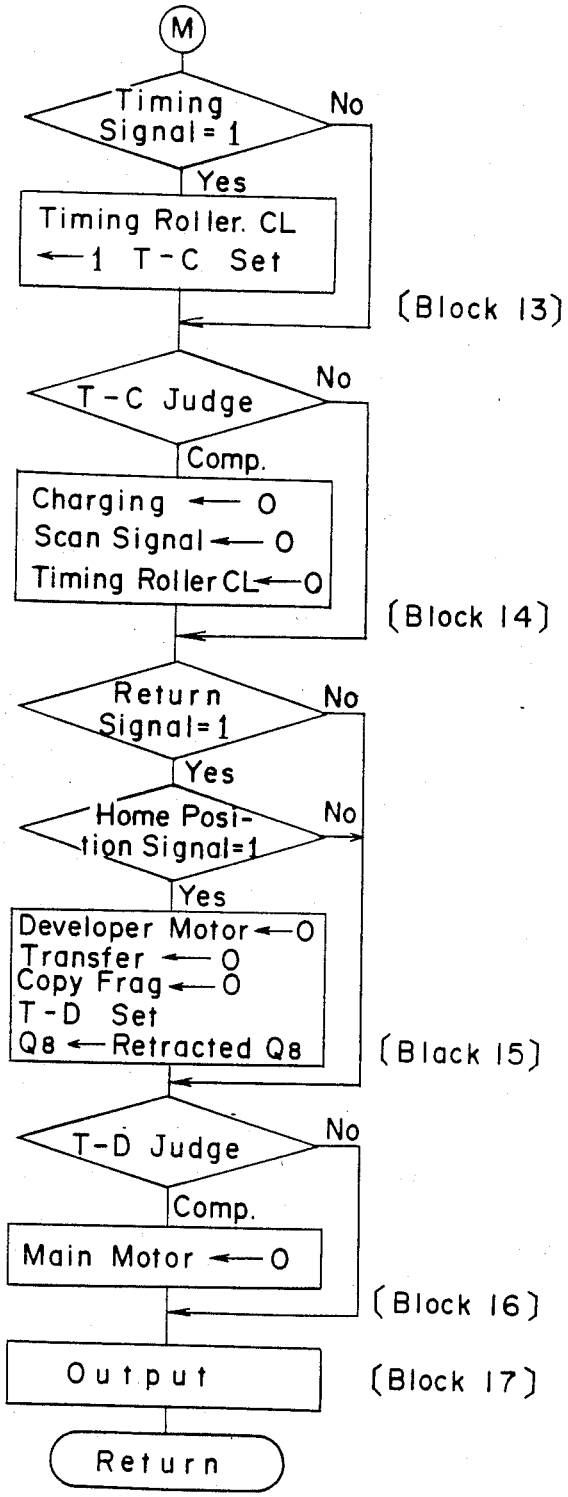
Figure 16:
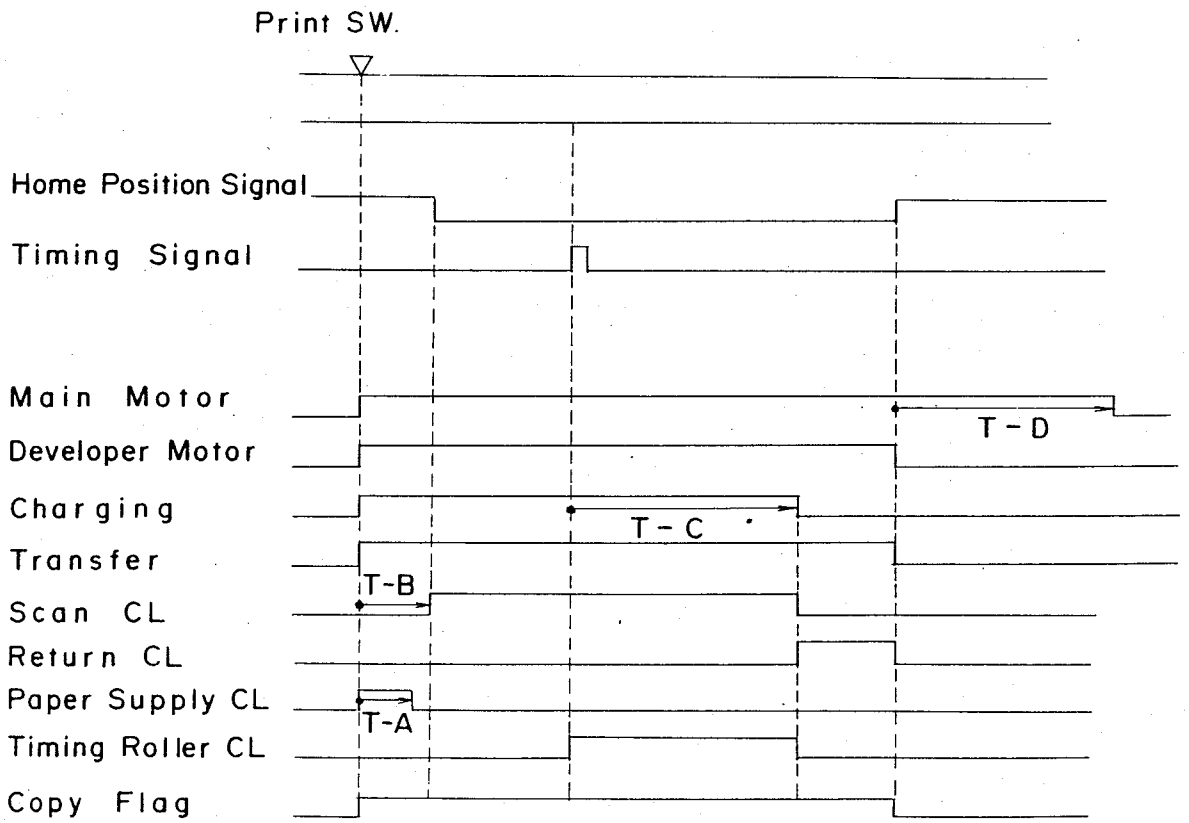
FIG. 16 is a chart of various waveforms showing an essential portion of the copying operation shown in FIG. 15.

FIG. 15, comprised of FIGS. 15(*a*) and 15(*b*), illustrates a flow chart showing the sequence of control of the copying operation of the copying machine. The flow chart will now be described, referring also to FIG. 16 showing a time chart.

In block 10, when print switch SW is depressed, or if the copy sheet flag is "1", a main motor, the developer motor, the charging and the transfer are rendered on and, if the A or B paper supply is selected, an A or B paper supply roller clutch, respectively is rendered on. Thereafter, the copy flag is rendered "1" and, then T-A (timer-A) and T-B (timer B) are set. In subsequent block 11, T-A is judged, and if it is the timing at which T-A is terminated, the A and B paper supply roller clutches are turned off. In block 12, T-B is judged, and if it is the timing at which T-B is terminated, the scan signal is rendered on. In block 13, when the timing signal becomes "1", timing roller CL is turned on and a T-C is set.

In block 14, at the timing of termination of T-C, the charging, scan signal and timing roller C1 are turned off. In block 15, when a return signal is "1", that is, when a home position SW is turned on upon the return of a scanner that has once left the home position, the developer motor and the transfer are rendered off, a copy flag is rendered "0", and a T-D is set while the magnification ratio or scale Q8 which has been retracted at step S706 is retrieved. In block 16, at the timing of termination of T-D, the main motor is turned off. In subsequent block 17, the result of the process which has taken place is outputted.

The timers T-A through T-D are respectively digital timers arranged to increase the counted value each time the main routine set in the CPU is executed and the contents of timers T-A through T-D are memorized in the CPU.

We claim:

1. In an operation device for use in a copying machine including a start means for starting a copying operation of the copying machine and fault detecting means for detecting a fault occurring in the copying machine operation such as the fault of the transferring of the copying paper of the fault of the control operation, the improvement characterized in that the start means comprises a manually operable key member having a cover plate made of a transparent material, a switch means being operable by a pushing operation of the key member for production of a signal to start the copying operation, display means of a light transmitting type disposed below the cover plate for displaying selectively one of a plurality of symbols each representing information concerning the operational status of the copying machine including at least a fault indication of the copying machine in response to a signal from the fault detecting means, and light emitting means disposed below the display means for illuminating the symbol on the display means through the cover plate.

2. The operation device according to claim 1, wherein said copying machine further comprises judging means for determining whether or not the copying machine is operable for a copying operation and for producing a signal and said light emitting means are adapted to be operable to vary the specific illuminating color depending on whether or not the copying machine is operable in response to the signal of the judging means.

3. The operation device according to claim 1, wherein said copying machine further comprises an automatic copying paper supply unit for supplying the copying paper automatically to the copying machine from a paper storage portion and a manual copying paper supplying unit for supplying coping paper to the copying machine and another judging means for judging which of the paper supplying unit is in operation and said display means includes means for displaying at least a symbol to represent when the manual copying paper supply unit is selected.

4. The operation device according to claim 2, wherein said copying machine further comprises an automatic copying paper supplying means for supplying the copying paper from a paper storage unit and paper detecting means for detecting a shortage of the copying papers in the paper storage unit and producing a signal, and the display means includes means for displaying a symbol representing a copying paper shortage in response to the signal from the paper detecting means when a shortage of the copying papers in the paper storage unit occurs.

5. The operation device according to claim 2, wherein said light emitting means are adapted to illuminate the key member with a color representing the inoperabe state in the copying machine in response to a signal from the fault detecting means.

6. The operation device according to claim 2, wherein said judging means includes a determining means for judging whether or not a fixing device for fixing the copied image on the copying paper has reached a predetermined temperature and for producing a signal which indicates that the copying machine is inoperable for a copying operation and the light emitting means are adapted to illuminate the display means with a color representing that the copying machine is inoperable in response to the signal from the determining means.

7. The invention of claim 1 wherein the display means simultaneously displays more than one symbol on the key member.

8. An operation device for use in a copying machine which includes start means for starting a copying operation of the copying machine, fault detecting means for detecting a fault occurring in the copying machine such as a fault in the transferring of the copying paper or the fault of the control operation and display means for displaying the presence of the fault comprising, said start means and the display means further comprising a manually operable key member for starting the copying operation of the copying machine, fault displaying means disposed on the top face of the key member for displaying to a user information representing the presence of a fault, and an additional display means for displaying the kind of fault upon operation of the start key member when a fault is present.

9. The operating device according to claim 8, wherein said start means further comprises light emitting means disposed in the key member for illuminating the key member with a predetermined colored light so as to change the color of the outer face of the key member whereby the key member can indicate the presence of a fault of the copying machine.

10. The operating device according to claim 8, wherein the fault displaying means is adapted to display one or more symbols and the additional display means are adapted to display one or more characters and/or numeric characters.

11. The operating device according to claim 8, wherein the additional display means can display the number of the copies to be made or the number of the copies made.

* * * * *